US007033010B2

(12) United States Patent
Bybee et al.

(10) Patent No.: US 7,033,010 B2
(45) Date of Patent: Apr. 25, 2006

(54) INK DELIVERY APPARATUS WITH COLLAPSIBLE INK CHAMBER AND METHOD OF USE

(75) Inventors: Cary R. Bybee, Lebanon, OR (US); Anthony D. Studer, Albany, OR (US); David J. Benson, Albany, OR (US); Bob Wickwire, Corvallis, OR (US); Kevin D. Almen, Albany, OR (US); David M. Hagen, Corvallis, OR (US)

(73) Assignee: Hewlett-Packard Development, L.P., Houston, TX (US)

( * ) Notice: Subject to any disclaimer, the term of this patent is extended or adjusted under 35 U.S.C. 154(b) by 167 days.

(21) Appl. No.: 10/664,687

(22) Filed: Sep. 16, 2003

(65) Prior Publication Data

US 2005/0057618 A1 Mar. 17, 2005

(51) Int. Cl.
*B41J 2/175* (2006.01)

(52) U.S. Cl. ..... 347/86

(58) Field of Classification Search ..... 347/85, 347/86, 87
See application file for complete search history.

(56) References Cited

U.S. PATENT DOCUMENTS

| | | | | |
|---|---|---|---|---|
| 5,153,612 | A * | 10/1992 | Dunn et al. | 347/87 |
| 5,646,664 | A * | 7/1997 | Pawlowski, Jr. | 347/86 |
| 5,734,401 | A * | 3/1998 | Clark et al. | 347/86 |
| 5,745,137 | A * | 4/1998 | Scheffelin et al. | 347/85 |
| 5,975,330 | A | 11/1999 | Sasaki et al. | |
| 6,158,062 | A | 12/2000 | Vespo | |
| 6,276,784 | B1 * | 8/2001 | Ikkatai et al. | 347/85 |
| 6,446,276 | B1 | 9/2002 | Mathis | |
| RE37,874 | E | 10/2002 | Pawlowski, Jr. et al. | |
| 6,536,887 | B1 | 3/2003 | Barinaga et al. | |

* cited by examiner

*Primary Examiner*—Shih-wen Hsieh

(57) ABSTRACT

An ink delivery apparatus includes a chamber configured to contain ink, where that chamber includes a proximal end for connection to the ink delivery apparatus, and opposing side portions having at least one tapered section configured to support the chamber and to facilitate at least partial controlled collapse of the chamber in response to a negative pressure.

36 Claims, 6 Drawing Sheets

INK DELIVERY APPARATUS WITH COLLAPSIBLE INK CHAMBER AND METHOD OF USE

BACKGROUND

A typical thermal inkjet may have an array of precisely formed nozzles attached to a print head substrate incorporating an array of firing chambers that receive liquid ink from a reservoir. Each firing chamber may include a thin-film resistor or firing resistor located opposite the nozzle to allow for the presence of ink between the firing resistor and the nozzle. Electric pulses may then be applied to heat the firing resistors to cause a small portion of the ink near the firing resistor to vaporize. The pressure created by this vaporization drives a small amount of ink through the nozzle. The nozzles may be arranged in a matrix array. Properly sequencing the operation of each nozzle in the array may cause character and/or images to form as the print head is moved with respect to a print medium, such as a piece of paper.

Efforts have been made to reduce the cost and size of ink-jet printers and to reduce the cost per printed page. Some of these efforts have focused on developing printers having small, moving print heads that are connected to larger stationary ink reservoirs by flexible ink tubes. This configuration is commonly referred to as "off-axis" printing.

The development of off-axis printing has created the need to precisely control the pressure of the ink at a variety of locations including the ink reservoir and the print head. Print cartridges may have an internal pressure regulator for regulating the flow of ink from an external source into an ink chamber within the print cartridge. Print cartridges with the internal pressure regulator often incorporate a diaphragm in the form of a bag. The inside of the bag is open to the atmosphere. The expansion and contraction of the bag controls the flow of ink into the print cartridge to maintain a relatively constant back pressure at the print head. However, when too much air has accumulated in the body and/or manifold of the print cartridge, the regulator may no longer have the capacity to maintain negative pressure. At that point, air in the print head may render nonfunctional any pressure regulator internal to, or leading to, the print cartridge. As a result, the back pressure may be lost (for example, due to variation in the temperature or pressure of the ambient environment), and ink may drool out of the print head. A drooling print head is capable of causing permanent damage to the printer. Moreover, a drooling print head provides unacceptable print quality.

Designs utilizing a separate pressure regulator may be relatively complicated. In addition, the use of a separate pressure regulator may limit the operating efficiency of the print device. Accordingly, recent efforts have been directed to providing a less complicated ink supply system that is able to reliably provide back pressure. Some designs utilize foam placed in the ink supply. The foam provides small capillary volumes which retain ink; the capillary attraction of the ink to the capillary volumes creates a back pressure. Similarly, other designs utilize a spring placed in an ink bag. With these designs, a significant amount of the ink in the supply may be stranded and therefore wasted. Such waste may require more frequent ink re-supply, thereby increasing the operating cost of the system.

SUMMARY

An ink delivery apparatus includes a chamber configured to contain ink, where that chamber includes a proximal end for connection to the ink delivery apparatus, and opposing side portions having at least one tapered section configured to support the chamber and to facilitate at least partial controlled collapse of the chamber in response to a negative pressure.

BRIEF DESCRIPTION OF THE DRAWINGS

The accompanying drawings illustrate various embodiments of the present apparatus and method and are a part of the specification. The illustrated embodiments are merely examples of the present apparatus and method and do not limit the scope of the invention.

Throughout the drawings, identical reference numbers designate similar, but not necessarily identical, elements.

DETAILED DESCRIPTION

An ink delivery apparatus and method of use are described herein. As used herein and in the appended claims, the term "ink" shall refer broadly to any ink, toner, colorant or other liquid marking fluid ejected by a print head. According to one exemplary embodiment described below, an ink delivery apparatus includes a chamber configured to contain ink, in which the chamber has a proximal end, a distal end, first and second pairs of opposing side portions disposed at least partially between the proximal and distal ends, and at least one tapered section defined in at least one side of the first pair of opposing side portions, the tapered section being configured to support the chamber and to facilitate an at least partial controlled collapse of the chamber in response to a negative pressure.

In the following description, for purposes of explanation, numerous specific details are set forth in order to provide a thorough understanding of the present apparatus and method. It will be apparent, however, to one skilled in the art that the present apparatus and method may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Exemplary Structure

Figure 1:
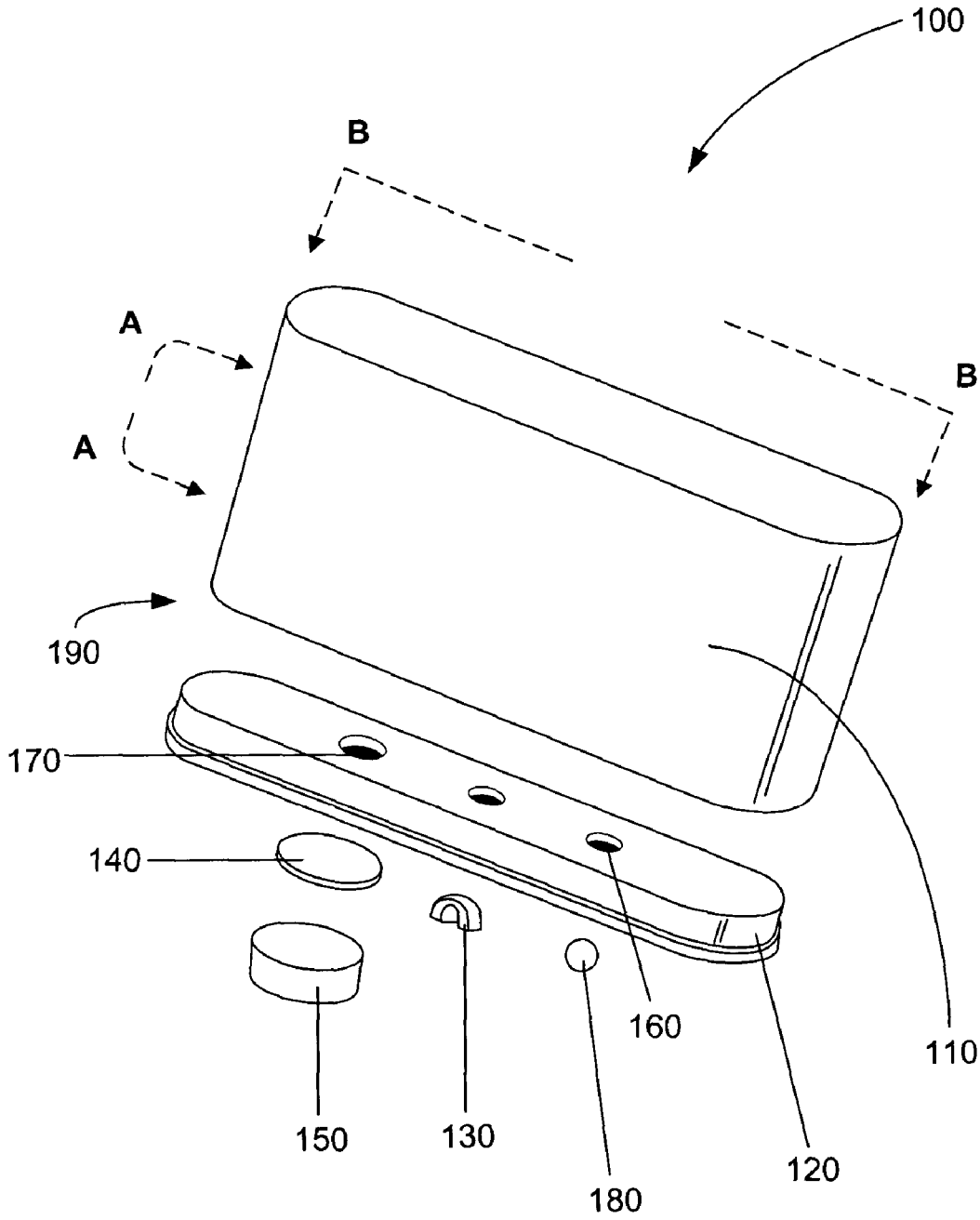
FIG. 1 illustrates an exploded view of an ink delivery apparatus according to one exemplary embodiment.
Figure 5:
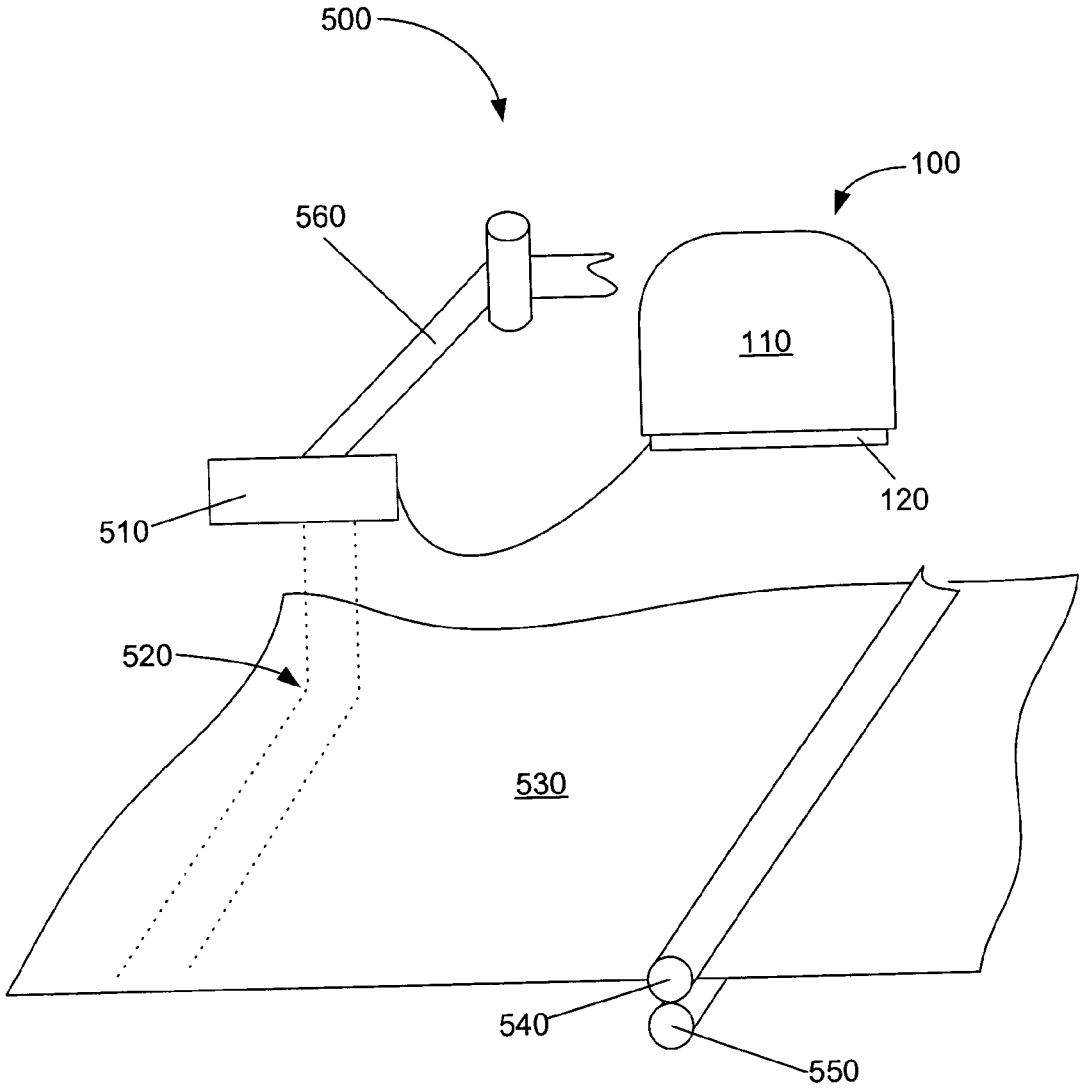
FIG. 5 illustrates a print device according to one exemplary embodiment.

FIG. 1 is an exploded view of an ink delivery apparatus (100) that generally includes a pressure tuned ink chamber (110), a fitment (120), a bubble generator (130), a filter screen (140), foam (150), first and second fluid interconnects (160, 170 respectively), and a plug (180). The pressure tuned ink chamber (110) may be fluidly coupled to the fitment (120). This coupling will be discussed further with reference to FIG. 3. The pressure tuned ink chamber (110) may be open on a proximal end (190). The pressure tuned ink chamber (110) may be initially filled with ink through the first fluid interconnect (160). The first fluid interconnect (160) may then be closed with the plug (180). The ink (not shown) may then flow from the pressure tuned ink chamber (110) through the second fluid interconnect (170) in the fitment (110) to a print head (510; FIG. 5), in which the first fluid interconnect may include the filter screen (140), and the foam (150).

Figure 2:
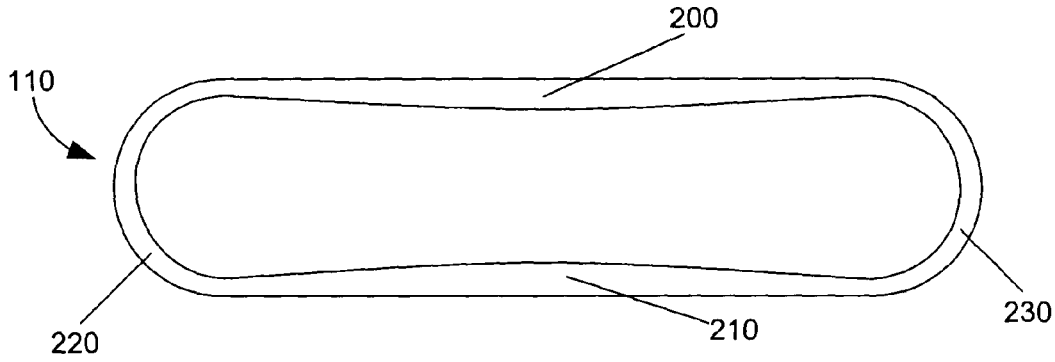
FIG. 2 illustrate a cross sectional view of the ink delivery apparatus of FIG. 1 taken along section A—A

FIG. 2 is a cross sectional view of an ink delivery apparatus (100; FIG. 1) taken along section A—A. As seen in the illustrated implementation, the pressure tuned ink chamber (110) generally includes four side members (200, 210, 220,230). Two of the opposing side members (200, 210) may be of varying thickness while the two rounded side members (220, 230) may be of substantially uniform thickness. The two tapered side members (200, 210) are configured to facilitate a controlled, resilient collapse of the pressure tuned ink chamber (110) over a range of negative pressures, thereby allowing for control of the negative pressure as ink is removed from the pressure tuned ink chamber (110). This control of the negative pressure in the ink chamber (110) may be utilized to maintain the negative pressure within a determined range while accounting for pressure fluctuations caused by such occurrences as variation in temperature or altitude. Temperature and altitude variations may cause air in the chamber to expand, thereby possibly affecting the negative pressure in the pressure tuned ink chamber (110). The selection of the materials and thickness of the walls of the pressure tuned ink chamber allow the pressure tuned ink chamber (110) to resiliently expand in response to a negative pressure without losing negative pressure. This reduces or eliminates the need for a separate pressure regulator. Accordingly, operation of a print device with an ink delivery apparatus (100) may be limited primarily by the performance characteristics of the print head by allowing for a nearly free withdrawal of all the ink available while preventing print head drool. In addition, the side members (200,210, 220, 230) are configured to provide support to the pressure tuned ink chamber (110), thereby minimizing or eliminating the need for external supports.

Figure 3:
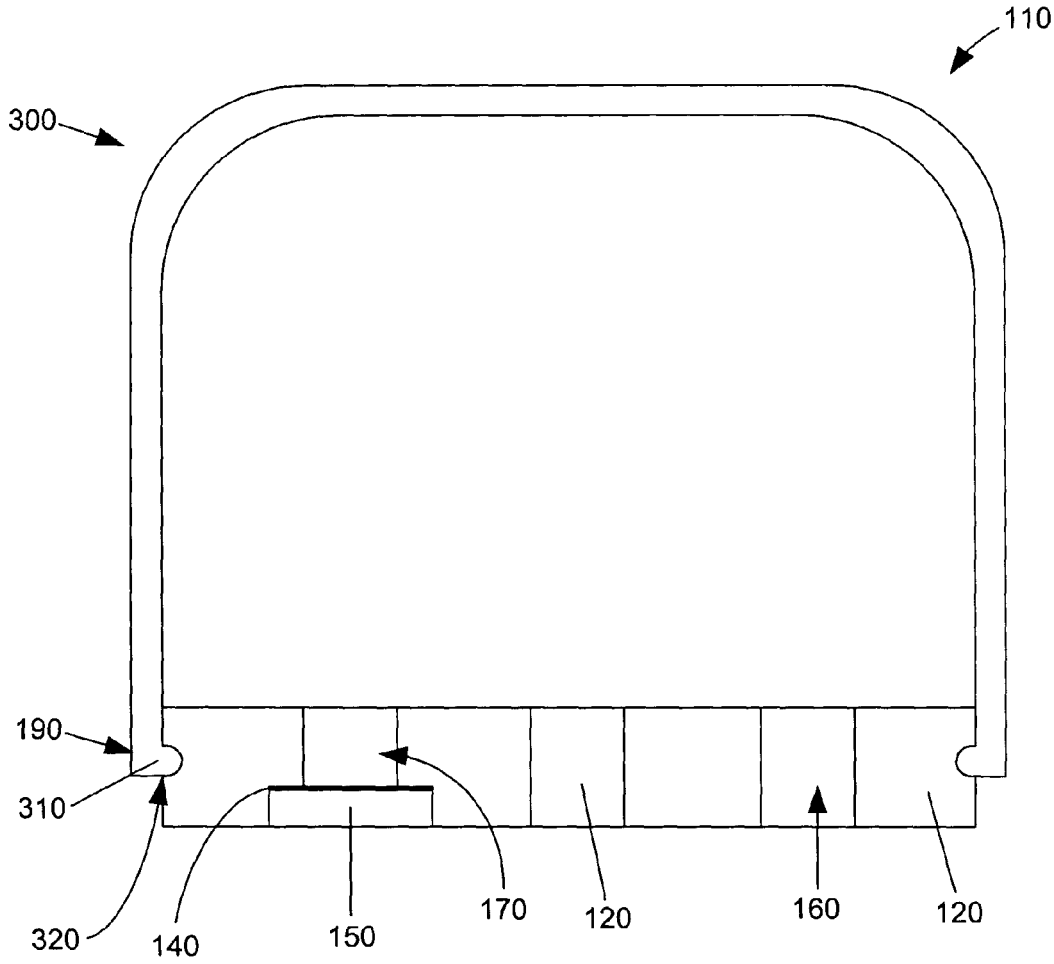
FIG. 3 illustrates a cross sectional view of the ink delivery apparatus of FIG. 1 taken along section B—B.

FIG. 3 is a cross sectional view of an ink delivery apparatus (100) similar to those illustrated in FIG. 1 taken along section B—B. The pressure tuned ink chamber (110) includes a proximal end (190) and a distal end (300). In the illustrated implementation, the distal end (300) is rounded. This configuration facilitates a more complete collapse of the pressure tuned ink chamber (110) by allowing the distal end (300) to at least partially collapse on itself in response to a negative pressure, thereby minimizing the volume of the distal end (300) and reducing the amount of stranded ink. In addition, such a configuration of the ink delivery apparatus may allow for a more complete evacuation of the pressure tuned ink chamber thereby increasing the volumetric efficiency of the apparatus.

FIG. 3 also illustrates a beaded portion (310) sealing the pressure tuned ink chamber (110) to the fitment (120). The beaded portion (310) may interface with a corresponding glandular region (320) in the fitment (120). Accordingly, the beaded portion (310) allows for the pressure tuned ink chamber (110) to be sealed to the fitment (120). The fitment may in turn facilitate coupling of the pressure tuned ink chamber (110) to a print head (510; FIG. 5). The ink flows through hole (330) in fitment (120) wherein is positioned the first fluid interconnect, which may include the filter screen (140) and the foam (150). The foam (150) may be a hydrophobic type of foam such as polyurethane. This configuration will be discussed further with reference to FIG. 5.

Exemplary Implementation and Operation

Figure 4:
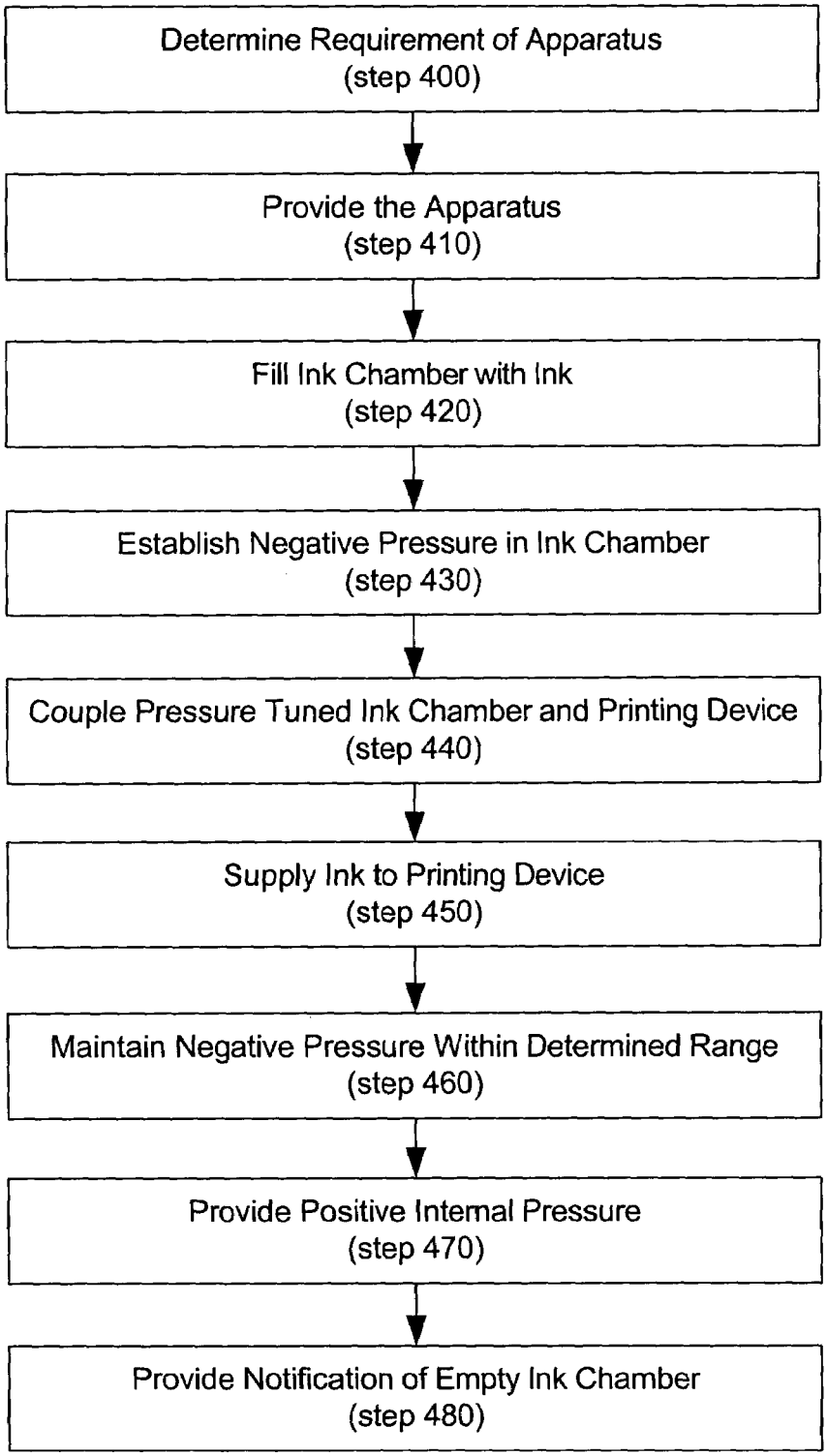
FIG. 4 is a flowchart illustrating a method of using an ink delivery apparatus according to one exemplary embodiment.

FIG. 4 is a flow chart illustrating a method of using the ink delivery apparatus illustrated above. The process begins by determining the requirements of the apparatus (400). These requirements may be based on the characteristics of a print device with which the ink delivery apparatus is going to be used. These characteristics may include, but are in no way limited to, the pressure and ink flow requirements of the print device. Such requirements may include, for example, a negative pressure range of 2–5" of water. Once the requirements of the print device have been determined (step 400), the pressure tuned apparatus is provided (step 410). This includes formation of a pressure tuned ink chamber wherein the tapered side sections are configured such that the pressure tuned ink chamber provides a determined amount of resistance over a range of negative pressures and allows for the maintenance of the negative pressure within determined limits. As previously discussed, this control facilitates improved performance of the print device by increasing volumetric efficiency and facilitating a nearly free withdrawal of ink. The ink delivery apparatus is then filled with ink (step 420). At this point, a negative pressure is established (step 430). The negative pressure may be established by withdrawing a small amount of ink from the pressure tuned ink chamber. Once the negative pressure has been established (step 430), the pressure tuned ink chamber is coupled to a print head (step 440). Once the pressure tuned ink chamber is coupled to the print head, ink is supplied to the print device (step 450). Operation of the print device will be discussed with reference to FIG. 5 below.

As the ink is supplied to the print device (step 450) the pressure in the pressure tuned ink chamber tends to become increasingly negative. As previously discussed, control of the negative pressure is desired to insure that the printing system functions properly. Without the influence of a negative pressure, the ink head may drool ink. Alternatively, if the negative pressure becomes too large, the print head may become starved for ink. Accordingly, it is desirable to control the negative pressure of the pressure tuned ink chamber within determined limits. These limits may be determined, in part, by the performance characteristics of the print device. The pressure may be controlled, at least in part, by partially collapsing the pressure tuned ink chamber in response to negative pressure (step 460) due to the withdrawal of ink from the pressure tuned ink chamber (step 450). In the event of a change in the ambient environment, the tapered sections may deflect slightly in order to compensate for the change while maintaining the negative pressure within the determined limits. Accordingly, the configuration of the pressure tuned ink chamber allows for maintenance of the negative pressure within determined limits while compensating for variations in the ambient environment. As previously discussed, this control may facilitate improved performance of the print device by increasing volumetric efficiency and facilitating a nearly free withdrawal of ink.

As ink is withdrawn from the ink delivery apparatus, the increasingly negative pressure may cause the distance between the two tapered side sections to decrease. The rounded distal end may at least partially collapse on itself forcing ink toward the proximal end of the pressure tuned ink chamber and thereby allowing for more complete withdrawal of ink from the chamber. In order to withdraw as much ink as possible from the ink supply, it may also be useful to provide a source of positive internal pressure (step 470) to the pressure tuned ink chamber. The provision of an internal pressure source (step 470) may be useful to maintain the negative pressure within the limits determined above.

This pressure may be provided by a bubble generator tuned to a pressure near the above determined upper pressure limit. Bubble generators, or "bubblers", permit ambient air bubbles to enter the ink reservoir when the back pressure within the reservoir exceeds the pressure to which the bubbler is "tuned". The purpose of the air bubbles delivered by the bubble generator is to keep the reservoir back pressure from increasing to a level that would cause failure of the print head. Bubble generators typically comprise a small-diameter orifice that provides fluid communication between the pen reservoir and ambient air. The bubble generator orifice is small enough, and the ink surface tension is great enough, to counteract the gravitational and static pressure forces that would otherwise cause ink to leak through the bubble generator orifice. Moreover, because the reservoir ink normally covers the reservoir-end of the bubble generator orifice, ambient air is restricted from entering the reservoir until the back pressure increases to a level great enough for drawing an air bubble through the reservoir ink covering the orifice. Other types of valves that perform an equivalent function are also known in the art.

Once nearly all of the ink has been withdrawn, the negative pressure may increase sharply. This sharp increase in negative pressure indicates that the ink supply and the pressure tuned chamber are operationally empty. Accordingly, the pressure may be monitored for a sharp increase in negative pressure. When such an increase is sensed, a user or the print device may be notified that the pressure tuned ink chamber is operationally empty (step 480). As discussed above, at least partial collapse of a pressure tuned ink chamber facilitates the maintenance of a negative pressure within determined pressure limits as ink is withdrawn from the pressure tuned ink chamber. Such control allows for enhanced print device performance. For example, in such systems maintenance of the negative pressure may allow the print device to operate at speeds limited primarily by the print head.

FIG. 5 illustrates a schematic representation of an off-axis print device (500). When in operation, a print head (510) is coupled to the ink delivery apparatus (100). The print head (510) selectively ejects drops of ink (520) onto a print medium (530) according to print job data to form desired text and/or images on the print medium (530). The print medium (530) is moved laterally with respect to the print head (510) by two driven rollers (540, 550). The print head (510) is moved back and forth across the print medium (530) by a drive belt (560) or other device. The print head (510) contains a plurality of firing chambers that are energized on command by selectively firing resistors such that, as the print head moves laterally across the print medium (530) and the print medium (530) is moved by the rollers (540, 550). drops of ink (520) fonn images on the print medium (530). Maintenance of the negative pressure within the pressure tuned ink chamber (110) within determined limits facilitates improved performance of the print device (500) by reliably supplying ink to the print head (510) while preventing the print head (510) from drooling ink onto the print medium (530) due to such occurrences as temperature or altitude variations. Further, providing a pressure tuned ink chamber allows for smaller print devices due to the volumetric efficiency of the pressure tuned ink chamber (110). Additionally, the relatively low part count associated with some implementations of the ink delivery apparatus (100; FIG. 1) may facilitate broader applications of print devices. Further, a pressure tuned ink chamber allows for more complete evacuation of ink than with other systems. As a result, ink re-supply may occur less often, thereby increasing the uptime of the print device (500) and decreasing the operating costs of the print device (500). In addition, the structural support and volumetric efficiency of the pressure tuned ink chamber (110) minimizes or eliminates the need of separate ink regulation systems.

The pressure tuned ink chamber (110) may be made of any material that allows the pressure tuned ink chamber (110) to be configured to at least partially collapse over a predetermined range of negative pressures. Such materials may include, but are in no way limited to elastomeric materials such as EDPM/Butyl. The pressure tuned ink chamber may be fabricated by any suitable means, such as, by way of example, molding. The foam (150) may be a hydrophobic type of foam such as polyurethane or any material suitable for forming a fluid interconnect. Similarly, the foam may be replaced by any structure suitable as a fluid interconnect.

Alternative Embodiments

Figure 6:
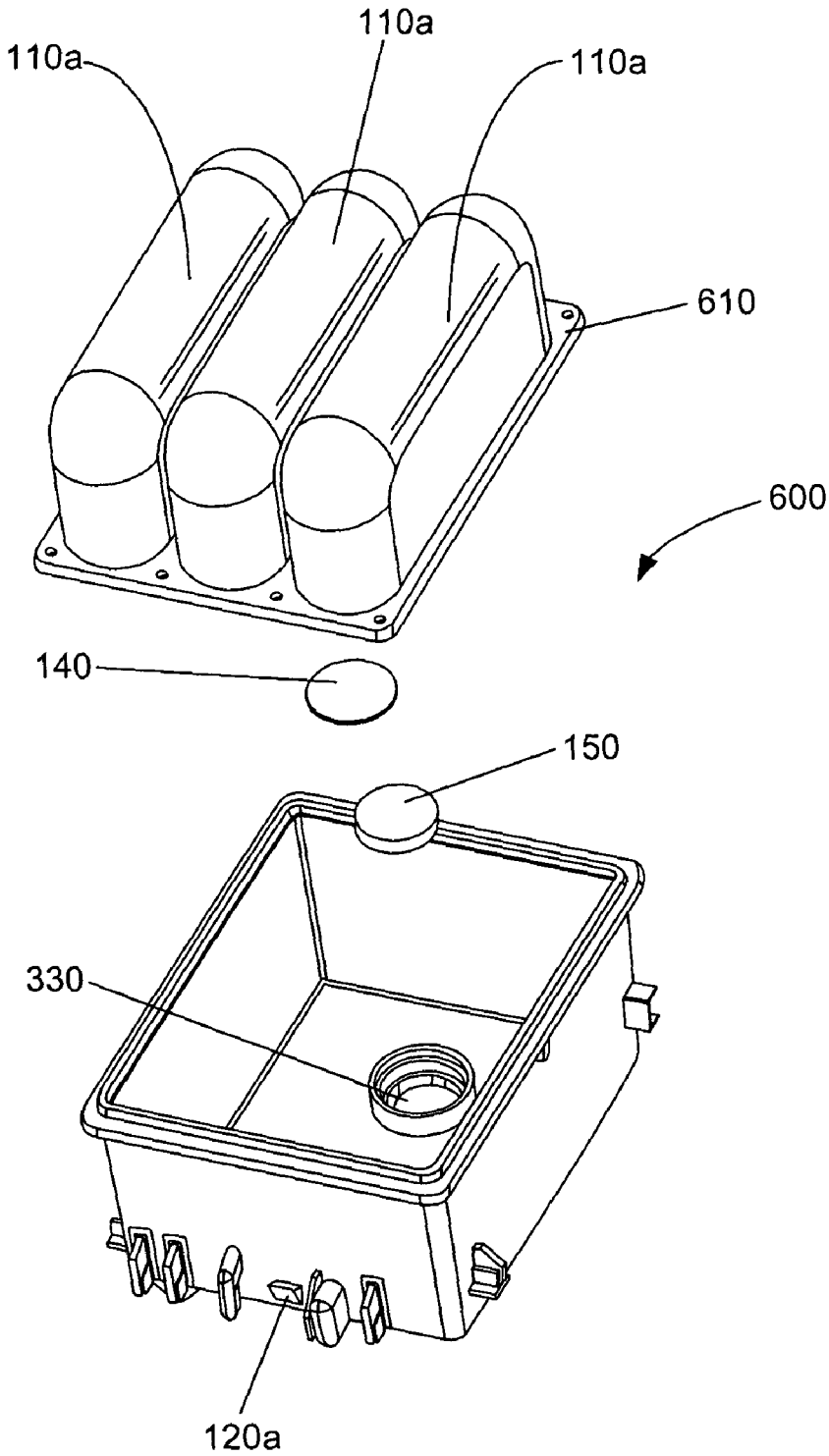
FIG. 6 illustrates an ink delivery apparatus according to one exemplary embodiment.

FIG. 6 illustrates an exploded view of an ink delivery system (600) including three pressure tuned ink chambers (110*a*). In the illustrated implementation, the pressure tuned ink chambers (110*a*) are coupled to the fitment (120*a*). A gasket seal (610) seals the pressure tuned ink chambers (110*a*) to the fitment (120*a*). Ink flow between the fitment (120*a*) and a print head (510; FIG. 5) occurs through the hole (330) and through a filter screen (140) and foam (150). A bubble generator (130; FIG. 1) may also be located within the fitment (120*a*). The use of a plurality of pressure tuned ink chambers (110) may provide for an increased volume of ink in the pressure tuned ink chamber (110) while maintaining the back pressure with the desired range during operation.

Further, in other embodiments, not shown, a plurality of pressure tuned ink chambers may be utilized to contain a plurality of ink colors, with each of the colors being separated one from another. Control of the negative pressure of the pressure tuned ink chambers (110) within determined limits facilitates improved performance of the print device (500; FIG. 5) by reliably supplying ink to the print head (510) while preventing the print head (510) from drooling ink onto the print medium (530). Further, providing a plurality of pressure tuned ink chambers allows for smaller color print devices due to the volumetric efficiency of each pressure tuned ink chamber (110). Smaller print cartridges may allow for a decrease in the overall size of print devices and facilitate broader applications of print devices.

Figure 7:
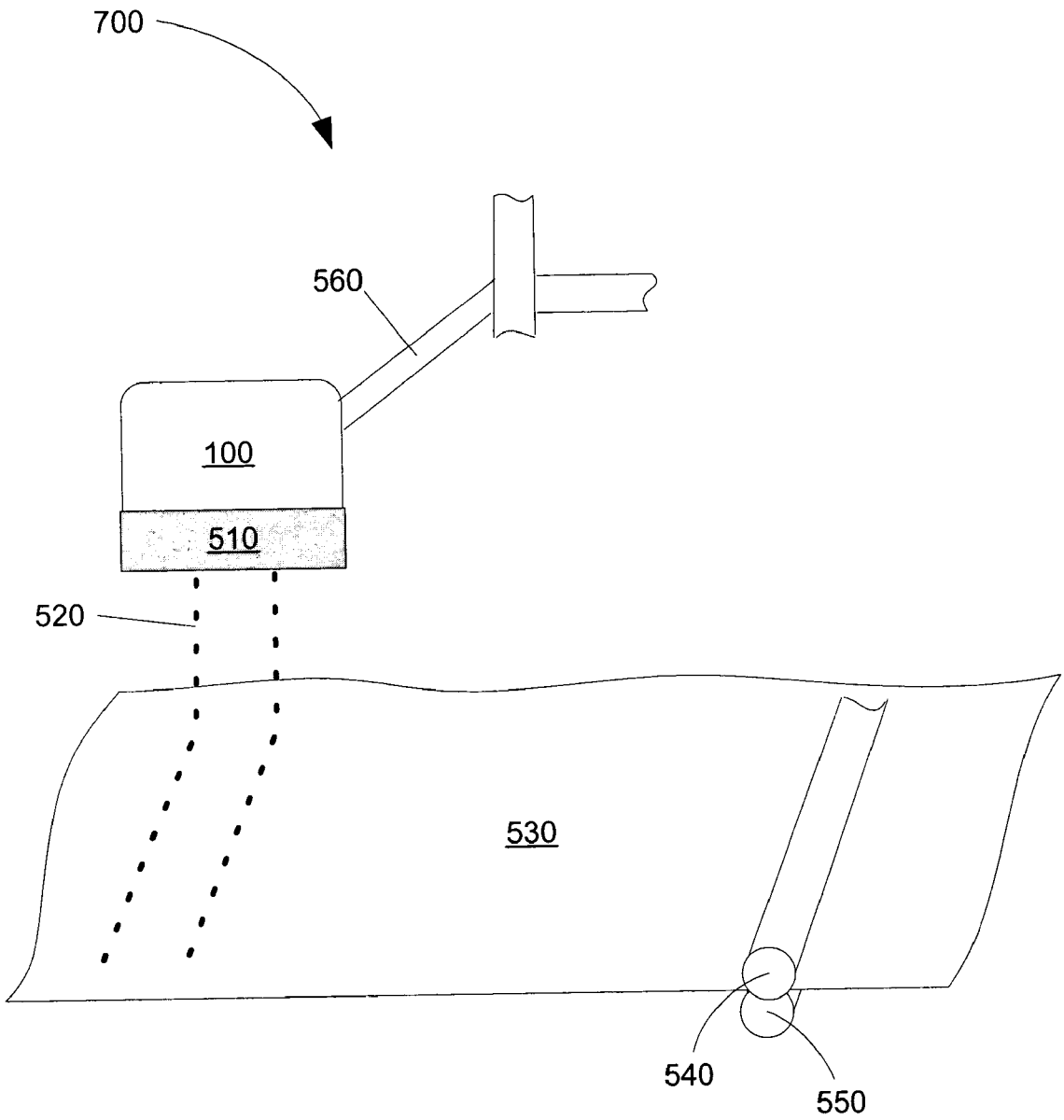
FIG. 7 illustrates a print device according to one exemplary embodiment.

FIG. 7 illustrates an on-axis print device (700), i.e., the ink supply is integrated into the print head. In such an embodiment, the ink delivery apparatus (100) may be coupled to a print head (510) in such an on-axis configuration. Accordingly, the ink delivery apparatus (100) may be directly coupled to a print head (510) or be utilized in stand-alone integrated print head systems. Similarly, the pressure tuned ink chamber described herein may be directly coupled to the print head (510). In such systems, the volumetric efficiency of the pressure tuned ink chamber allows for smaller print cartridges. In addition, the volumetric efficiency of the pressure tuned ink chamber may decrease overall operating costs by requiring less frequent ink supply replenishment.

Other embodiments (not shown) may utilize at least one pressure tuned ink chamber coupled to a page-wide array of inkjets. Further, the pressure tuned ink delivery apparatus (100; FIG. 1) may be configured for use in any system requiring control or regulation of negative or back pressures. In addition, the foam (160; FIG. 1) may be replaced by a septum or other type of fluid interconnect.

The preceding description has been presented only to illustrate and describe embodiments of invention. It is not intended to be exhaustive or to limit the invention to any precise form disclosed. Many modifications and variations are possible in light of the above teaching. It is intended that the scope of the invention be defined by the following claims.

What is claimed is:

1. An ink delivery apparatus comprising a chamber configured to contain ink, said chamber having:

a proximal end; and opposing side portions having at least one section with a tapered thickness configured to support said chamber and to facilitate at least partial controlled collapse of said chamber in response to a negative pressure and wherein said tapered thickness is configured to resiliently expand said chamber in response to a change in ambient conditions so as to maintain said negative pressure within a pre-determined range.

2. The apparatus of claim 1, wherein said chamber further comprises a distal end opposite said proximal end, said distal end being rounded.

3. The apparatus of claim 1, further comprising at least one section having a tapered thickness in each of said opposing side portions.

4. The apparatus of claim 3, wherein each opposing side portion comprises a central portion with thickness that decreases to either side of said central portion.

5. The apparatus of claim 1, further comprising rounded side portions at ends of said opposing side portions.

6. The apparatus of claim 1, wherein said chamber comprises an elastomeric material.

7. The apparatus of claim 6, wherein said chamber comprises a EDPM/Butyl material.

8. The apparatus of claim 1, further comprising a fitment coupled to said proximal end of said chamber.

9. The apparatus of claim 1, wherein said controlled collapse comprises a decrease in a distance between said opposing side portions.

10. An ink delivery assembly, comprising:

at least one pressure tuned ink chamber having a proximal end and a distal end; and a first pair of opposing side walls, each said wall having a thickness and a section where said thickness tapers and is configured to resiliently expand in response to a change in ambient conditions so as to maintain a pressure within a pre-determined range; and a fitment coupled to said chamber.

11. The assembly of claim 10, wherein said apparatus further comprises a plurality of pressure tuned ink chambers.

12. The assembly of claim 11, wherein said plurality of pressure tuned ink chambers comprises three chambers.

13. The assembly of claim 11, wherein said plurality of pressure tuned ink chambers comprises a plurality of ink colors, each color being separately contained within one of said plurality of chambers.

14. The assembly of claim 11, further comprising a sealing gasket disposed at least partially between said plurality of chambers and said fitment.

15. The assembly of claim 11, wherein said fitment is configured to be coupled to a print head.

16. The assembly of claim 10, further comprising a second pair of opposite side portions joining said first pair of opposing side portions to form said chamber, said second pair of opposing side portions being rounded.

17. The assembly of claim 10, wherein said sections of tapered thickness of said first pair of opposing side portions support said chamber while allowing a controlled collapse of said chamber in response to a negative pressure within said chamber.

18. A print device, comprising:

at least one pressure tuned ink chamber having a proximal end and a distal end; and a first pair of opposing side walls, each said wall having a thickness and a section where said thickness tapers to facilitate resilient expansion of said chamber in response to a change in ambient conditions so as to maintain a negative pressure within said chamber within a pre-determined range;

a fitment coupled with said chamber having a fluid interconnect; and a print head coupled to said fitment.

19. The device of claim 18, further comprising a bubble generator in said fitment.

20. The device of claim 18, wherein said chamber is configured to at least partially collapse in response to said negative pressure to maintain said negative pressure within said determined range.

21. The device of claim 18, wherein said tapered sections are opposing and each comprise central portion with thickness of said tapered sections decreasing to either side of said central portion.

22. The device of claim 18, wherein said assembly further comprises a plurality of pressure tuned ink chambers.

23. The device of claim 22, wherein said plurality of pressure tuned ink chambers comprises three pressure tuned ink chambers.

24. The device of claim 23, wherein said plurality of pressure tuned ink chambers comprises a plurality of ink colors, each color being separately contained within one of said plurality of pressure tuned ink chambers.

25. The device of claim 24, further comprising a sealing gasket disposed at least partially between said plurality of pressure tuned ink chambers and said fitment.

26. The device of claim 18, wherein said fluid interconnect is configured to fluidly couple a print head and said chamber, and further comprising a second fluid interconnect, said second fluid interconnect being configured to fluidly couple an ink supply and said chamber.

27. The device of claim 18, wherein said chamber comprises an off-axis ink supply.

28. The device of claim 18, wherein said chamber comprises an on-axis ink supply.

29. The device of claim 18, wherein said fitment is configured to directly couple with a print head.

30. The print device of claim 18, further comprising a second pair of opposite side portions joining said first pair of opposing side portions to form said chamber, said second pair of opposing side portions being rounded.

31. The print device of claim 18, wherein said sections of tapered thickness of said first pair of opposing side portions support said chamber while allowing a controlled collapse of said chamber in response to a negative pressure within said chamber.

32. A method of delivering liquid ink, comprising:

providing at least one pressure tuned ink chamber containing an ink, said chamber including side walls comprising at least one section with a wall thickness that tapers;

establishing a negative pressure in said chamber;

supplying said ink to a print head;

regulating a level of said negative pressure within a pre-determined range using said section of tapered wall thickness, while at least partially resiliently collapsing a portion of said chamber in response to said negative pressure; and resiliently expanding said chamber in response to a change in ambient conditions so as to maintain said negative pressure within said pre-determined range, said section of tapered wall thickness facilitating said expanding.

33. The method of claim 32, wherein said regulating negative pressure comprises substantially resiliently collapsing said chamber over said pre-determined range of said negative pressure.

34. The method of claim 32, further comprising monitoring a level of ink in said chamber.

35. The method of claim 32, further comprising providing notification of a substantial increase in said negative pressure.

36. The method of claim 32, further comprising providing a plurality of said pressure tuned ink supply chambers.

* * * * *

UNITED STATES PATENT AND TRADEMARK OFFICE

CERTIFICATE OF CORRECTION

PATENT NO. : 7,033,010 B2
APPLICATION NO. : 10/664687
DATED : April 25, 2006
INVENTOR(S) : Cary R. Bybee et al.

It is certified that error appears in the above-identified patent and that said Letters Patent is hereby corrected as shown below:

On the title page, item (73), in "Assignee", in column 1, line 1, after "Development" insert -- Company --.

Signed and Sealed this

Fourteenth Day of April, 2009

JOHN DOLL
*Acting Director of the United States Patent and Trademark Office*